US006517284B2

(12) United States Patent
Gamache

(10) Patent No.: US 6,517,284 B2
(45) Date of Patent: Feb. 11, 2003

(54) RESERVOIR DRAINAGE SYSTEM

(76) Inventor: Jean-Claude Gamache, 31, rue du Parc, St-Clet, QBC (CA), J0P 1S0

( * ) Notice: Subject to any disclaimer, the term of this patent is extended or adjusted under 35 U.S.C. 154(b) by 3 days.

(21) Appl. No.: 09/839,490

(22) Filed: Apr. 23, 2001

(65) Prior Publication Data

US 2002/0154951 A1 Oct. 24, 2002

(51) Int. Cl.[7] ..... E02B 11/00

(52) U.S. Cl. ..... 405/51; 405/53; 405/36; 405/52; 526/5; 526/169

(58) Field of Search ..... 405/53, 51, 36, 405/50, 52, 37; 52/169.5, 302.3

(56) References Cited

U.S. PATENT DOCUMENTS

| | | | | | |
|---|---|---|---|---|---|
| 235,754 | A | * | 12/1880 | Durham | 137/247.51 |
| 870,433 | A | * | 11/1907 | Hodges | 405/50 |
| 1,320,256 | A | * | 10/1919 | McIeod | 52/169.5 |
| 1,811,009 | A | * | 6/1931 | Hartmann | 52/169.5 |
| 2,157,290 | A | * | 5/1939 | Henderson | 52/274 |
| 3,852,925 | A | * | 12/1974 | Gazzo | 52/302.3 |
| 3,940,940 | A | * | 3/1976 | Barrett | 137/312 |
| 4,136,500 | A | | 1/1979 | DiFiore | |
| 4,142,344 | A | | 3/1979 | Palmaer | |
| 4,290,252 | A | * | 9/1981 | Demirel et al. | 52/169.14 |
| 4,298,294 | A | * | 11/1981 | Zimmerman | 405/37 |
| 4,523,875 | A | | 6/1985 | DiFiore | |
| 4,534,143 | A | * | 8/1985 | Goines et al. | 405/36 |
| 4,538,386 | A | * | 9/1985 | DiCello | 405/43 |
| 4,620,817 | A | * | 11/1986 | Cushing | 137/357 |
| 4,877,350 | A | | 10/1989 | DiFiore | |
| 5,248,225 | A | | 9/1993 | Rose | |
| 5,465,434 | A | * | 11/1995 | Coe | 4/546 |
| 5,551,797 | A | | 9/1996 | Sanford | |
| 5,836,115 | A | | 11/1998 | Clay et al. | |
| 5,931,603 | A | * | 8/1999 | Swain et al. | 405/229 |

* cited by examiner

*Primary Examiner*—Heather Shackelford
*Assistant Examiner*—Katherine Mitchell

(57) ABSTRACT

A reservoir drainage system drains water away from a soil around a footing foundation of a structure and collects the drained water outside of the same. The system includes a network of drainage tubes externally rounding a perimeter of the footing foundation and connected to a collecting tube. The latter collects the drained water from the network and directs it by gravity into a collecting reservoir member located outside of the structure below a bottom level of the foundation. The drainage network has a first part that is substantially horizontally leveled and longitudinally runs along a first portion of the perimeter and generally against the same. The network also includes a second part that continues the first part, is connected to it at an upper end and longitudinally runs along a complementary second portion of the perimeter. The second part slightly outwardly diverts away and is downwardly inclined from the footing foundation down to a lower end connected to the collecting tube.

20 Claims, 5 Drawing Sheets

RESERVOIR DRAINAGE SYSTEM

FIELD OF THE INVENTION

The present invention relates generally to a drainage system and more particularly to a reservoir drainage system for draining water from a soil around a footing foundation of a structure with a drained water collection outside of the structure for different purposes such as elimination of water damages to the structure and its foundation and the like.

BACKGROUND OF THE INVENTION

In many parts of the world, particularly where the water table is high, housing and structures are water damage-prone for damages such as a footer (or footing) cracking due to foundation settling and a high humidity level inside that structure. Obviously, all those damages could results in discomfort and costly repairs, if indeed can be fixed. For this reason, various drainage systems have been used in the past.

U.S. Pat. No. 5,551,797 issued on Feb. 17, 1995 to Sanford discloses a protection system of a new structure by installing under said structure a sump pomp drainage system during its construction. This under structure approach is largely expensive and potentially ineffective because of its great humidity level generated inside the structure.

U.S. Pat. No. 5,248,225 issued on Aug. 17, 1992 to Rose teaches a drainage system with excavation trenches within the soil around at least a portion of the perimeter of the building foundation. This system diverts the drained water only from an upper level of the footer foundation, leaving room for water to accumulate below the same and keep the soil wet at the foundation level and vulnerable to possible settlings.

U.S. Pat. Nos. 4,136,500, 4,523,875 and 4,877,350 granted on Jan. 30, 1979, Jun. 18, 1985 and Oct. 31, 1989 respectively to DiFiore disclose foundation drainage systems being continuously graded around the full perimeter of the foundation thus continuously draining water and potentially inducing partial soil settlings. Furthermore, the quantity of particulate material extending below and between the drainage tube and the footing, and substantially high above the footing, or footer, could potentially retain huge amount (high column) of water in case of natural disasters that could dramatically damage the foundation as well as inducing soil settling.

It therefore would be desirable to provide effective drainage system for draining a soil under a structure and collecting drained water outside of the structure and re-use that collected water for different purposes.

OBJECTS OF THE INVENTION

An object of the present invention is to provide a reservoir drainage system that obviates the above-mentioned disadvantages.

Another object of the present invention is to provide a reservoir drainage system that reliably and cost effectively solves problems associated with the drainage.

A further object of the present invention is to provide a reservoir drainage system that prevents any absorption of water by soil at and above the bottom level of the footing foundation of the construction.

Still another object of the present invention is to provide a reservoir drainage system that eliminates any moisture under and in proximity around the construction, with no need of drain hole with anti-back flow valve in the basement floor.

Still a further object of the present invention is to provide a reservoir drainage system that allows for water collected outside of the structure to be re-used for different purposes, such as landscape and grass watering and the like.

Yet a further object of the present invention is to provide a reservoir drainage system that prevents water damage to the basement floor in case of high water table while ensuring a small humidity level required by the concrete to maintain good structural characteristics.

An advantage of a drainage system of the present invention installed around a footing foundation of a building is that it is a protection for:

- the owner/residents of the building by eliminating high humidity level inside the building that causes them discomfort and sickness;
- the building by keeping its surroundings dry to prevent cracking and settling of its foundation; and
- the environment by collecting re-usable natural water.

Other objects and advantages of the present invention will become apparent from a careful reading of the detailed description provided herein, within appropriate reference to the accompanying drawings.

SUMMARY OF THE INVENTION

According to an aspect of the present invention, there is provided a reservoir drainage system for draining water from a soil around a footing foundation of a structure and collecting the drained water outside of said structure, said drainage system comprises a network of drainage tubes externally rounding a perimeter of said footing foundation and being connected to at least one collecting tube collecting drained water from said network and directing said water by gravity into a collecting reservoir member located outside of said structure below a bottom level of said foundation, said network of drainage tubes having a first part substantially horizontally leveled and longitudinally running along a first portion of said perimeter and being generally thereagainst, and a second part connected to and continuing said first part at an upper end at and longitudinally running along a complementary second portion of said perimeter, said second part slightly outwardly diverting away and being downwardly inclined from said footing foundation down to a lower end connected to said at least one collecting tube.

Preferably, the system further comprises a coupling member to connect said first part to said lower end of said second part.

Preferably, the first part generally covers from 60% to 80% of said network.

Preferably, the reservoir member has a discharge system for evacuating said drained water away from the same, and is a manhole reservoir member with a free opening at a ground level for allowing maintenance of the same.

Preferably, the collecting tube is substantially downwardly inclined from said lower end of said second part down to said collecting reservoir member, with a same inclination as of said second part.

Preferably, the reservoir member has at least one filtering means being located inside the same below a receiving opening connected to said collecting tube.

Preferably, the receiving opening is generally located at half height of said reservoir member.

Preferably, the discharge system has at least one pump and a water-level indicator.

Preferably, the pump is connected to a watering system or discharges into a city sewer network.

Preferably, the system further comprises at least one generally upwardly oriented clean-out member being connected to said first part of said network of drainage tubes, and having an access located slightly above a ground level for cleaning out said network.

Preferably, the system further comprises a porous aggregate material longitudinally covering said network of drainage tubes for facilitating flowing of said water to said network and providing a volume within which water is received and temporarily retained when said drainage system operating at capacity, said network being laid down on a substantially pristine natural soil and said aggregate material not extending above said footing foundation.

Preferably, the system further comprises a water porous sheet-like material entirely surrounding said network of drainage tubes and said at least one collecting tube for preventing soil particulates from getting into the same and drain said soil.

According to a second aspect of the present invention, there is provided a reservoir drainage system for draining water from a soil around a footing foundation of a structure and collecting the drained water outside of said structure, said drainage system comprises an external network of drainage tubes externally rounding a perimeter of said footing foundation and being connected to at least one collecting tube collecting drained water from said external network and directing said water by gravity into a collecting reservoir member located outside of said structure below a bottom level of said foundation, an internal network of drainage tubes being located inside said perimeter of said footing foundation, said external network of drainage tubes having a first part substantially horizontally leveled and longitudinally running along a first portion of said perimeter and being generally thereagainst, and a second part connected to and continuing said first part at an upper end and longitudinally running along a complementary second portion of said perimeter, said second part slightly outwardly diverting away and being downwardly inclined from said footing foundation down to a lower end connected to said at least one collecting tube, said internal network having at least two interconnected drainage tubes being generally diagonally positioned to substantially cover an area determined by said perimeter, at least one of said interconnected tubes being integrally connected by a connecting tube to said first part of said external network through said foundation, said internal network being substantially horizontally oriented parallel to said first part of said external network and underneath a basement floor of said structure.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
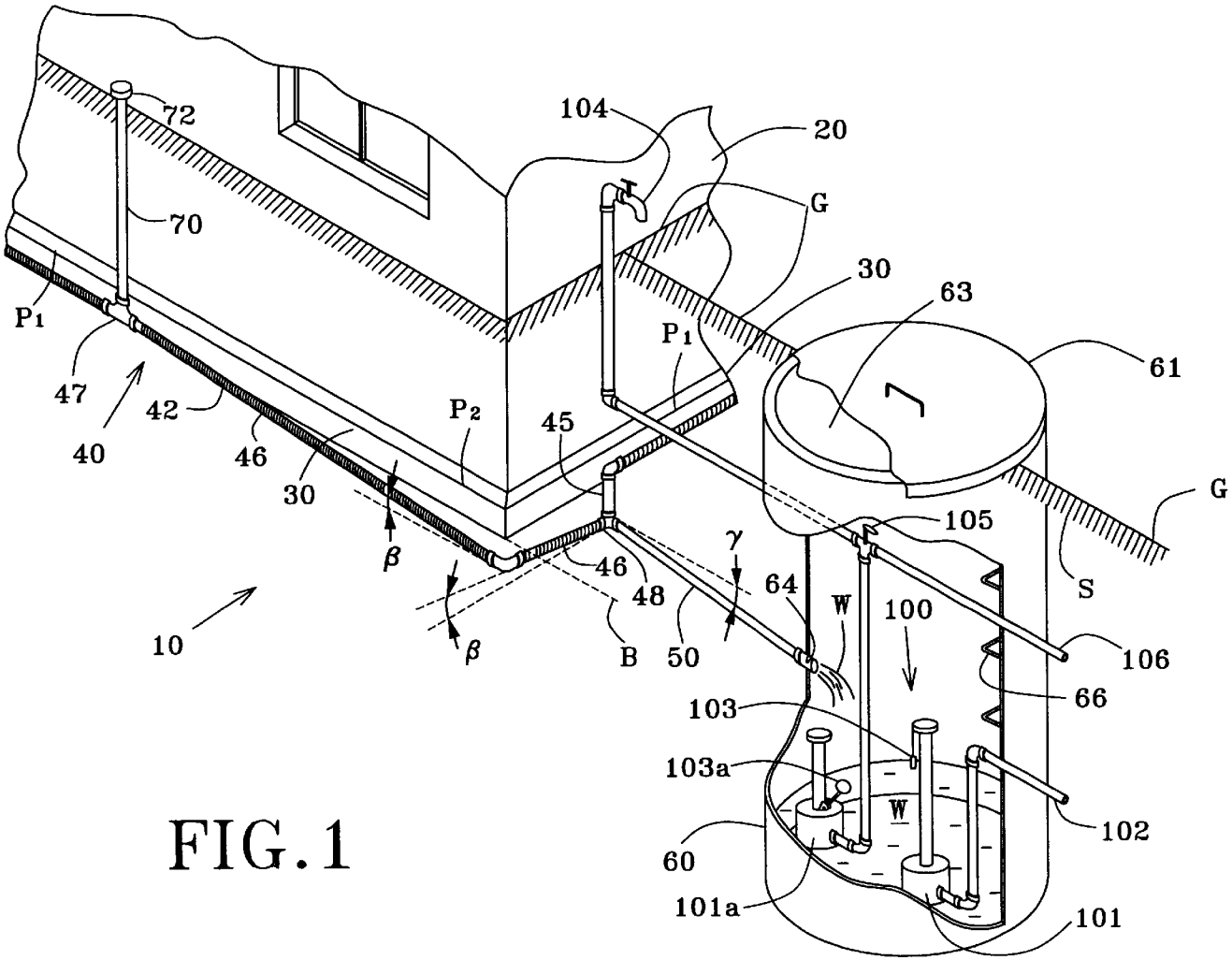
FIG. 1 is a broken perspective view of an embodiment of a reservoir drainage system according to the present invention.

Referring to FIG. 1, there is shown an embodiment of a reservoir drainage system 10 according to the present invention for draining a soil S around a footing foundation 30 of a structure 20 and collecting the drained water outside of the structure 20 such that it can be re-used and serve different purposes.

Figure 2:
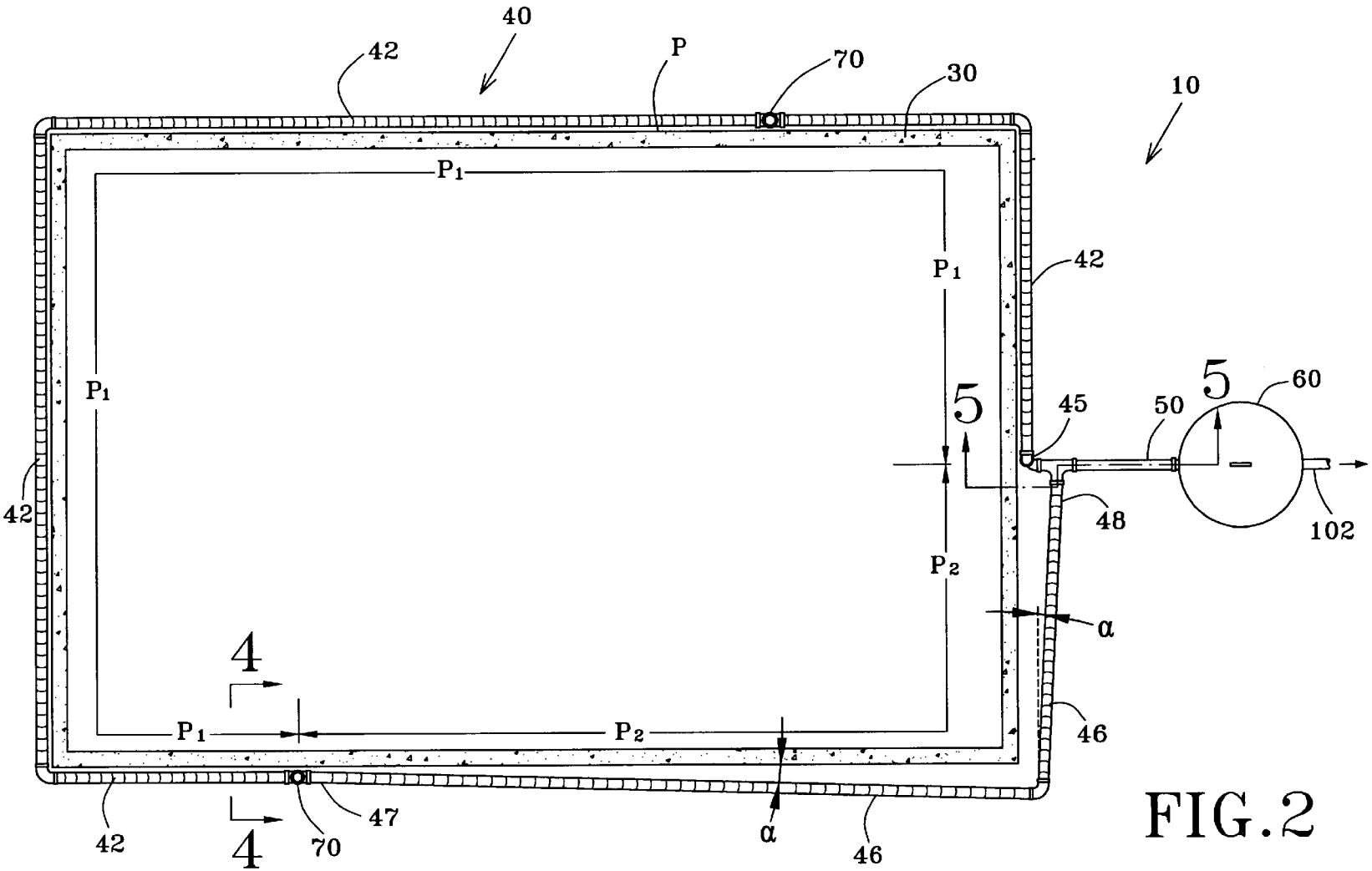
FIG. 2 is a top plan view of the embodiment of FIG. 1.

As shown in FIGS. 1 and 2, the drainage system 10 includes a network 40 of drainage tubes externally rounding a perimeter P of the footing foundation 30 and connected to a collecting tube 50 that collects the drained water W from the network 40 and directs it by gravity into a collecting reservoir member 60 located outside of the structure 20 below a bottom level B of the foundation 30. The network 40 of drainage tubes has a first part 42 and a second part 46. The first part 42 is substantially horizontally leveled and longitudinally runs along a first portion P1 of the perimeter P and generally against the same. The second part 46 is connected to and continues the first part 42 at an upper end 47, and longitudinally runs along a complementary or remaining second portion P2 of the perimeter P. The first P1 and second P2 portions form the perimeter P. The second part 46 slightly outwardly diverts away (shown by an angle a in FIG. 2) and is downwardly (shown by an angle β in FIG. 1) inclined from the footing foundation 30 down to a lower end 48 connected to the collecting tube 50.

The network 40 is at, and not below, the bottom level B of the foundation 30 in order to prevent possible soil S erosion underneath the same 30 that could cause soil settling and consequently damages to the foundation 30, while preserving a certain humidity level at the foundation 30 for the latter to maintain good structural properties.

Preferably, the system 10 further has a coupling member 45 to connect the first part 42 to the lower end 48 of the second part 46.

The inclination angle β of the second part 46 is required to drain any water W that would accumulate in the first part 42 of the network 40. The draining effect of the water W induces some slight soil S particulate drainage, such as very low soil erosion below the bottom level B of the foundation 30. To ensure that this erosion occurs away from the footing foundation 30, to avoid settling of the same 30, the second part 46 is set to divert away with the angle α. The total outward deviation of the second part 46 from the foundation 30 due to the angle α is generally in the order of twelve to eighteen (12 to 18) inches, while the total inclination (or height drop from level B) of the second part 46 from horizontal level B due to the inclination angle β is generally in the order of one to two (1 to 2) inches, between the upper end 47 to the lower end 48 of the same 46.

Figure 3:
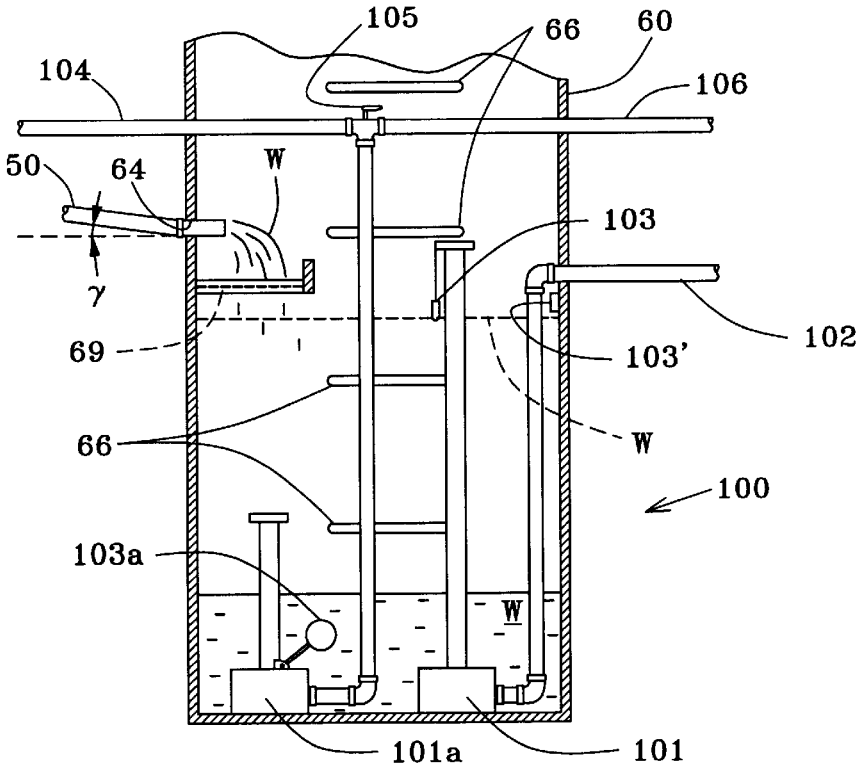
FIG. 3 is a broken section view of a collecting reservoir member.
Figure 4:
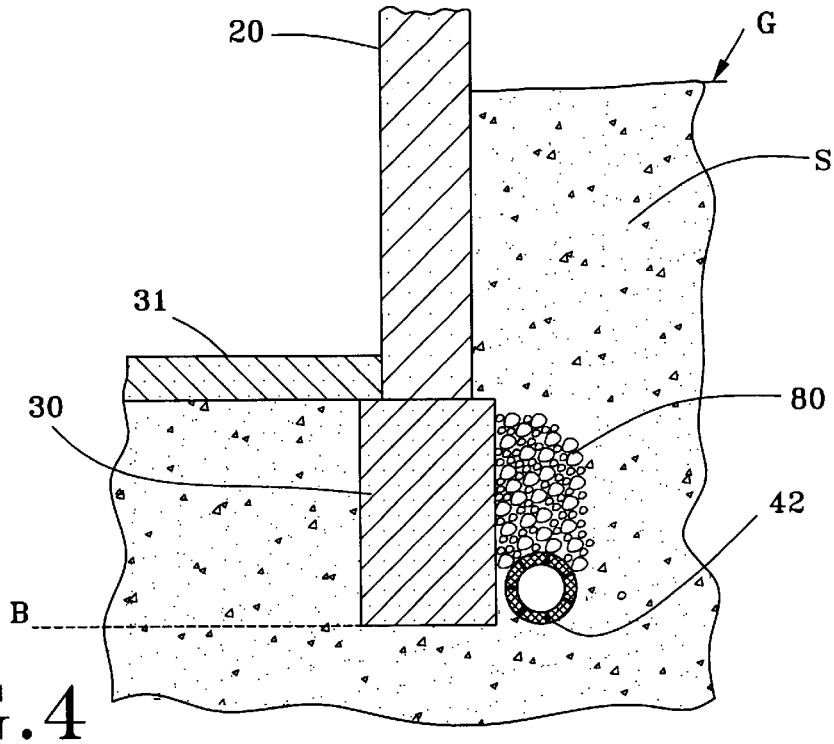
FIG. 4 is a broken section view taken along line 4—4 of FIG. 2.

As illustrated in FIGS. 1, 3 and 4, the collecting tube 50 is substantially downwardly oriented (shown by angle γ) and extends from the lower end 48 of the second part 46 to the collecting reservoir member 60. The inclination angle γ of the collecting tube 50 is preferably the same as the inclination angle β of the second part 46 (γ=β).

The first part 42 typically covers between 60% and 80% of the network 40 of drainage tubes. The drainage tubes of the network 40 are typically known in the art perforated tubing or the like, while the collecting tube 50 is preferably a solid tubing (non-perforated).

As illustrated in FIGS. 1 and 3, the reservoir member 60 has a discharge system 100 for evacuating the drained water W away from the same 60. Preferably, the reservoir member 60 is a manhole reservoir member with a free opening 63 at a ground level G for allowing maintenance of the same 60. The reservoir member 60 includes a servicing ladder 66 inside the same 60.

The reservoir member 60 preferably has a filtering means 69 located inside the same 60 below a receiving opening 64 connected to the collecting tube 50. The receiving opening 64 is generally located at half height of the reservoir member 60. The discharge system 100 has at least one pump 101 connected to a water-level sensor 103. The pump 101 is preferably a sump pump used for evacuating the drained water out of the reservoir 60 to the city sewer network 102 or the like when the water level gets close to the receiving opening 64. A water-level indicator (not shown) connected to a second water level sensor 103' is used as a safety to indicate to the building resident that a critical water level has been reached inside the reservoir 60, meaning that the pump 101 is most likely either out of service or not powerful enough to efficiently empty the manhole 60. While the sensor 103' is within the manhole 60, it is preferably connected to a corresponding visual (such as a lamp) indicator (not shown) located inside the structure 20.

A second pump 101*a* with its own water level sensor 103*a* is preferably connected through a valve 105 to either an external green water faucet 104 that allows for re-use of the drained water W for washing the car or a grass watering system 106 for watering the landscape or the grass, or both. Similarly, other usage of the collected drained water W could also be considered such as a water purifying system or the like.

The drainage system 10 also includes at least one, preferably two, generally upwardly vertically oriented clean-out members 70 connected to the first part 42 of the network 40 of drainage tubes. Each clean-out member 70 has an access opening 72 located slightly above the ground level G for periodically cleaning out the network 40, thus ascertaining proper operation of the drainage system 10 at a future time, by pouring water therein for example. Preferably, one of the clean-out members 70 is connected to the first part 42 of the network 40, in proximity to the upper end 47 of the second part 46, while the second one 70 would essentially be at the opposite location around the perimeter P also connected to the first part 42, closer to the coupling member 45 and the collecting tube 50.

Figure 5:
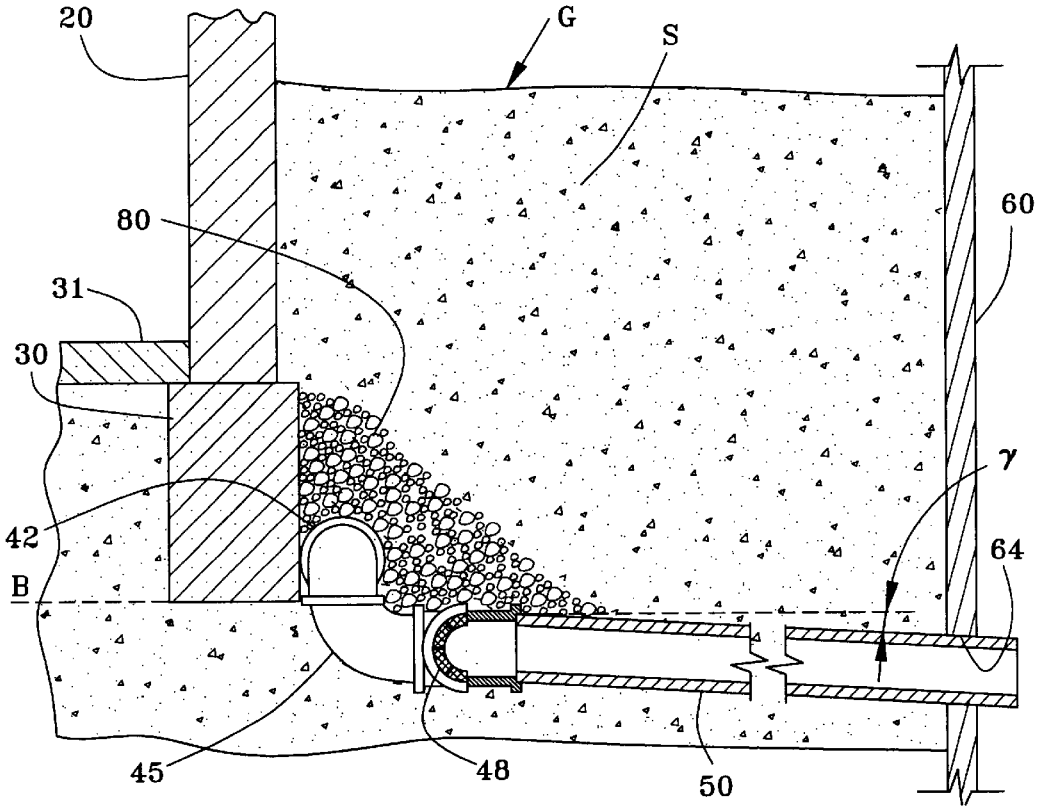
FIG. 5 is a broken section view taken along line 5—5 of FIG. 2.

Referring to FIGS. 4 and 5, the drainage system 10 includes a porous aggregate material 80, such as widely used slag, longitudinally covering the network 40 of drainage tubes for facilitate water W flowing down to the network 40 and provide a volume within which water W may be received and temporarily retained when the drainage system 10 operates at capacity. The network 40 is generally laid down on a substantially pristine natural or compacted soil S and the aggregate material 80 substantially covers the outward lateral portion and the top portion of the tubes of the network 40, without extending above the footing foundation 30 such that no water is ever retained above the same 30 to avoid any infiltration inside the structure 20 thereby.

As commonly known in the art, a water porous sheet-like material (not shown) preferably entirely wraps the drainage tubes of the network 40 to prevent soil particulates from getting into the same that would induce drainage and erosion of the soil S.

Figure 7:
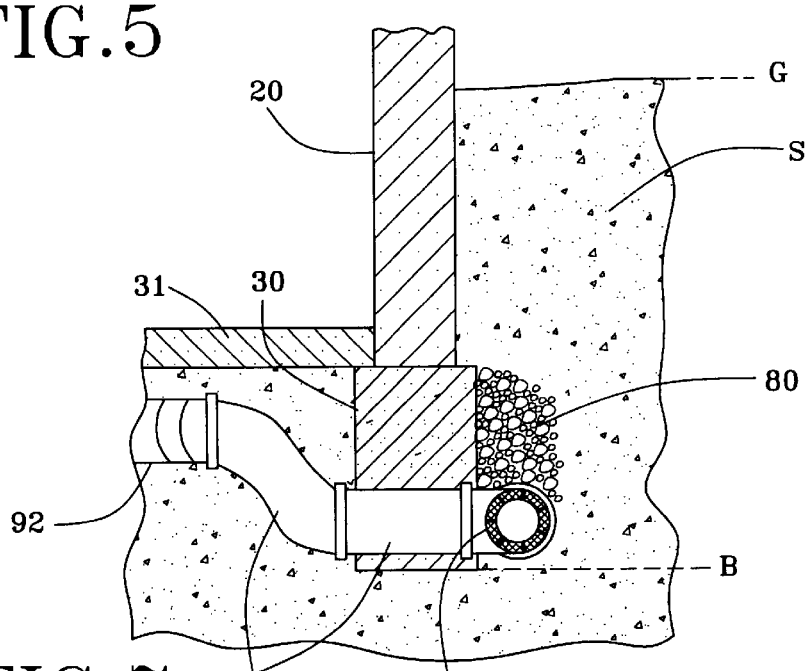
FIG. 7 is a broken section view taken along line 7—7 of FIG. 6.
Figures 6, 6A:
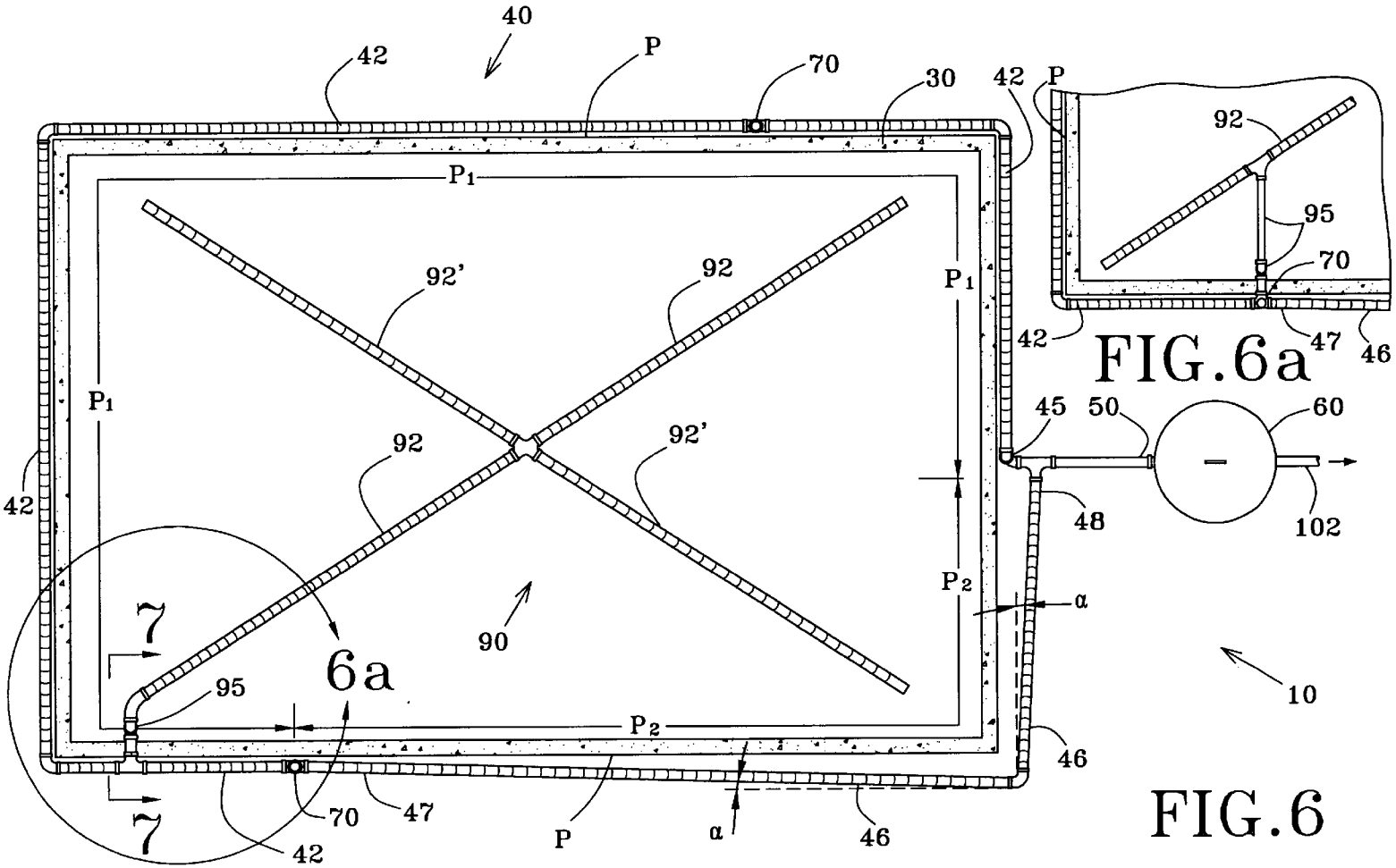
FIG. 6 is a view similar to FIG. 2, showing the embodiment of FIG. 1 with an additional internal network of drainage tubes.
FIG. 6*a* is a view taken along line 6*a* of FIG. 6, showing another connecting embodiment between external and internal networks.

Referring to FIGS. 6, 6*a* and 7, the present reservoir drainage system 10, when installed in a relatively high water table area for draining water W from a soil S around a footing foundation 30 of a structure 20 and collecting the drained water W outside of the structure, preferably further includes, in addition to the external network 40 of drainage tubes, an internal network 90. The internal network 90 has at least two interconnected drainage tubes 92 and 92' generally diagonally positioned to substantially cover an area determined by the perimeter P. At least one of the interconnected tubes 92 and 92' is integrally connected by a connecting tube 95 to the first part 42 of the external network 40 through the foundation 30. The internal network 90 is substantially horizontally oriented and parallel to the first part 42 of the external network 40 and underneath the basement floor 31 of the structure 20 to prevent any possible soil erosion underneath the concrete based basement floor 31 laying on the soil S and on the foundation 30 at its edges.

Alternatively, as illustrated in FIG. 6*a*, the interconnection between the internal 90 and external 40 networks could be so located to merge at the connection between the clean-out member 70, the first 42 and second 46 parts of the external network 40.

As shown in FIG. 7, the internal network 90 of drainage tubes are preferably leveled slightly above the level of the first part 42 of the external network 40, in order to preserve a certain humidity level at the floor 31 for the latter to maintain good structural properties.

The present reservoir drainage system 10 works in the following manner. Networks 40 and 90 of drainage tubes located as above described collect and drain the soil water W coming from around and under the structure 20. The drained water W is discharged from all of drainage tubes 42, 46, 92 and 92' through the collecting tube 50 and receiving opening 64 into the reservoir member 60. Consequently, there is absolutely no need of having a drain hole, with anti-back flow valve or not, on the basement floor 31 of the structure 20, thereby eliminating all excessive and uncomfortable humidity level therein.

After sufficient accumulation of water W in the reservoir member 60, the drained water W (shown in FIG. 3) is re-distributed into a city sewer network 102 or a grass watering system 106, or the like through a faucet 104 via a valve 105 by the discharge system 100. For servicing, the reservoir member 60 is equipped with a free opening 63 releasably covered by a cover 61 and a servicing ladder 66 for an operator to easily get therein. Preferably, when the bottom level B of the foundation 30 is four (4) feet deep, the reservoir member 60 is approximately eight (8) feet deep from the ground level G, thereby capable of containing a huge amount of water W therein. Preferably, the reservoir member 60 is located away from the foundation 30 by a distance typically varying from four (4) to ten (10) feet.

Although the present drainage system has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A reservoir drainage system for draining water from a soil around a footing foundation of a structure and for collecting the drained water away from said structure, said footing foundation defining a perimeter and a bottom level thereof, said drainage system comprising:

a network of drainage tubes externally rounding said perimeter of said footing foundation and connected to at least one collecting tube for collecting drained water from said network and for directing said water by gravity into a collecting reservoir member located away from said structure below said bottom level, said network of drainage tubes having a first part substantially horizontally leveled and a second part, said second part defining an upper end and a lower end, said first part longitudinally running along a corresponding first portion of said perimeter and being generally thereagainst, said second part being connected to and continuing said first part at said upper end and longitudinally running along a complementary second portion of said perimeter, said second part diverting outwardly away from said footing foundation and being downwardly inclined down to said lower end connected to said at least cone collecting tube.

2. A drainage system as defined in claim 1, further comprising a coupling member connecting said first part to said lower end of said second part.

3. A drainage system as defined in claim 1, wherein said first part generally covers from 60% to 80% of said network.

4. A drainage system as defined in claim 1, wherein said reservoir member has a discharge system for evacuating said drained water away from said reservoir member.

5. A drainage system as defined in claim 4, wherein said reservoir member has at least one filtering means located inside said reservoir member below a receiving opening thereof connected to said at least one collecting tube.

6. A drainage system as defined in claim 5, wherein said receiving opening is generally located at half height of said reservoir member.

7. A drainage system as defined in claim 4, wherein said discharge system has at least one pump and a water-level indicator.

8. A drainage system as defined in claim 7, wherein said at least one pump is connected to a watering system.

9. A drainage system as defined in claim 7, wherein said at least one pump discharges into a city sewer network.

10. A drainage system as defined in claim 1, wherein said reservoir member is a manhole reservoir member with a free opening at a ground level for allowing maintenance of said reservoir member.

11. A drainage system as defined in claim 1, wherein said at least one collecting tube is substantially downwardly inclined from said lower end of said second part down to said collecting reservoir member.

12. A drainage system as defined in claim 11, wherein said at least one collecting tube generally has a same inclination as of said second part.

13. A drainage system as defined in claim 1, further comprising at least one generally upwardly oriented clean-out member connecting to said first part of said network of drainage tubes, and having an access located above a ground level for cleaning out said network.

14. A drainage system as defined in claim 1, further comprising a porous aggregate material longitudinally covering said network of drainage tubes for facilitating flowing of said water to said network and providing a volume within which water is received and temporarily retained when said drainage system operates at capacity, said network being laid down on a substantially pristine natural soil and said aggregate material not extending above said footing foundation.

15. A drainage system as defined in claim 1, further comprising a water porous sheet-like material entirely surrounding said network of drainage tubes and said at least one collecting tube for preventing soil particulates from getting therein, thereby preventing the drainage of said soil.

16. A reservoir drainage system for draining water from a soil around a footing foundation of a structure and for collecting the drained water away from said structure, said footing foundation defining a perimeter and a bottom level thereof, said perimeter defining an enclosed area, said drainage system comprising:

an external network of drainage tubes externally rounding said perimeter of said footing foundation and connected to at least one collecting tube for collecting drained water from said external network and for directing said water by gravity Into a collecting reservoir member located away from said structure below said bottom level, an internal network of drainage tubes located inside said perimeter within said enclosed area of said footing foundation, said external network of drainage tubes having a first part substantially horizontally leveled and a second pant, said second part defining an upper end and a lower end, said first part longitudinally running along a corresponding first portion of said perimeter and being generally thereagainst, said second part being connected to and continuing said first part at said upper end and longitudinally running along a complementary second portion of said perimeter, said second part diverting outwardly away from said footing foundation and being downwardly inclined down to said lower end connected to said at least one collecting tube, said internal network having at least two Interconnected drainage tubes being generally diagonally positioned to substantially cover said enclosed area, at least one of said interconnected tubes including a connecting tube, said connecting tube extending through said foundation and connecting to said first part of said external network, said internal network being substantially horizontally oriented parallel to said first part of said external network and underneath a basement floor of said structure.

17. A drainage system as defined in claim 16, wherein said reservoir member is a manhole reservoir member with a free opening at a ground level for allowing maintenance of said reservoir member and having a discharge system for evacuating said drained water away from said reservoir member.

18. A drainage system as defined in claim 16, further comprising at least one generally upwardly oriented clean-out member connecting to said first part of said external network of drainage tubes at an intersection with said internal network, and having an access located above a ground level for cleaning out said networks.

19. A drainage system as defined in claim 16, further comprising a porous aggregate material longitudinally covering said external network of drainage tubes for facilitating flowing of said water to said network and providing a volume within which water is received and temporarily retained when said drainage system operates at capacity, said networks being laid down on a substantially pristine natural soil and said aggregate material not extending above said footing foundation.

20. A drainage system as defined in claim 16, wherein said internal network of drainage tubes is leveled above said first part of said external network.

* * * * *